US006121739A

United States Patent [19]

Haberlander

[11] Patent Number: 6,121,739

[45] Date of Patent: Sep. 19, 2000

[54] DOSING PUMP AND METHOD FOR ENHANCING DOSING PRECISION

[75] Inventor: Albert Haberlander, Traunstein, Germany

[73] Assignee: Lang Apparatebau GmbH, Siegsdorf, Germany

[21] Appl. No.: 09/331,529

[22] PCT Filed: Dec. 15, 1997

[86] PCT No.: PCT/EP97/07038

§ 371 Date: Jun. 23, 1999

§ 102(e) Date: Jun. 23, 1999

[87] PCT Pub. No.: WO98/28539

PCT Pub. Date: Jul. 2, 1998

[30] Foreign Application Priority Data

Dec. 23, 1996 [DE] Germany ..... 196 54 084

[51] Int. Cl.[7] ..... H02P 3/08

[52] U.S. Cl. ..... 318/362; 318/365; 318/757

[58] Field of Search ..... 318/470, 362, 318/363, 364, 365, 757, 758, 759, 760, 762; 417/24, 45

[56] References Cited

U.S. PATENT DOCUMENTS

| | | | |
|---|---|---|---|
| 3,714,536 | 1/1973 | Foster | 318/470 |
| 4,110,670 | 8/1978 | Araki et al. | 318/212 |
| 4,195,255 | 3/1980 | Guttmann | 318/762 |
| 4,245,483 | 1/1981 | Murai | 62/376 |
| 4,354,147 | 10/1982 | Klaussner | 318/363 |
| 4,721,439 | 1/1988 | Leinweber | 417/319 |
| 5,198,734 | 3/1993 | Johnson | 318/369 |
| 5,449,992 | 9/1995 | Geiger et al. | 318/362 |

FOREIGN PATENT DOCUMENTS 0 246 335 11/1987 European Pat. Off. .

*Primary Examiner*—Bentsu Ro
*Assistant Examiner*—Rita Leykin
*Attorney, Agent, or Firm*—Wayne C. Jaeschke; Glenn E. J. Murphy; Kenneth Watov

[57] ABSTRACT

The invention relates to a method for enhancing the dosing precision of a dosing pump which is driven by an asynchronous motor via an eccentric gear. The supply of the motor is cut off approximately half a cycle time before a desired dosing pause period or stoppage. The motor freewheels afterwards for part of the cycle time, before a direct voltage is applied to it for approximately a quarter cycle time, such that an eddy current is induced in the rotor, which produces an antipolarized magnetic field which brakes the rotor.

16 Claims, 1 Drawing Sheet

DOSING PUMP AND METHOD FOR ENHANCING DOSING PRECISION

BACKGROUND

1. Field of the Invention

This invention relates generally to methods and apparatus for dosing liquids, and more particularly to a method and apparatus for increasing the dosing precision of a dosing pump.

2. Discussion of Related Art

Dosing pumps are used for the precision dosing of different liquids. Typically a dosing pump is actuated by external pulses, by a standard signal or by an internal clock. The external pulses can also be generated, for example, by a liquid counter and optionally multiplied or divided. Through use of an eccentric gear, the diaphragm or the piston of the pump is supposed to complete a stroke, the maximum stroke frequency generally amounting to about 125 strokes/minute.

Asynchronous motors are preferably used for dosing for metering pumps with a motor output of about 40 watts or higher. Through their moment of inertia, asynchronous motors are capable of slowing down without braking when switched off. This results in overdosing. With motor outputs of about 40 to 60 watts, the slowing down responsible for this overdosing can be reduced, but not avoided, by stiffening the mounting or by fitting a pressure-retaining valve. A particular problem can arise where the diaphragm is driven through an eccentric gear. If the motor comes to a stop outside its dead center, the starting torque for the next cycle can exceed the permitted value so that the motor does not start.

Mechanical brakes are unsuitable for stroke frequencies of more than 3- strokes/minutes. Hitherto, electrical brakes have only been practicable for motors with an output of more than 1 kilowatt and for braking times of more than 1 second. In the case of electromagnetic braking, the electromagnetic forces are in any case only used to drive mechanical brakes. With eddy-current brakes, additional external parts are necessary which is expensive and makes such brakes impossible to use for small motors.

SUMMARY OF THE INVENTION

If exact dosing is to be achieved, controlled braking of the pump motor is essential. Accordingly, the problem addressed by the present invention is to develop a method for braking the motor of a dosing pump in such a way that the diaphragm or the piston of a dosing pump comes to a stop in the exact dead center position after the suction stroke. The dead center position after the suction stroke is also known as the rear dead center. Another problem addressed by the invention is to develop a dosing pump to carry out this method which would not require additional parts on the motor. Braking times of well below 1 second are desired, and be suitable for a range of motor sizes.

The problems stated have been solved by one embodiment of the invention in which the motor supply voltage to a motor of a dosing pump is switched off about half a cycle time before a required dosage stoppage, the motor then running freely for part of the cycle time before a d.c. voltage is applied to the motor for about one quarter of the cycle time so that an eddy current is induced in the rotor which generates a counter-magnetic field that brakes the rotor to a standstill. Another embodiment of the invention a dosing pump includes a motor driven by a motor supply voltage adapted to be switched off about half the cycle time before a desired stoppage, the self induction voltage in the free-running motor then falls to a value which does not affect a braking circuit, after which a d.c. voltage is applied to the motor for about one quarter of the cycle time so that an eddy current is induced in the rotor and generates a counter-magnetic field which brakes the rotor to a standstill.

The advantage of the method according to the invention is that the motor itself is the brake and no additional parts are needed. A particular advantage is that the d.c. voltage can be applied by simple means. The d.c. voltage required for braking may be taken from a battery or an accumulator. However, it may also be provided directly or by transformation from the operating voltage or, with particular advantage, by rectification and storage in a capacitor.

BRIEF DESCRIPTION OF THE DRAWINGS

Various embodiments of the invention are described in detail below with reference to the drawings, in which the items are identified by the same reference designation, wherein.

DETAILED DESCRIPTION OF THE INVENTION

Figure 1:
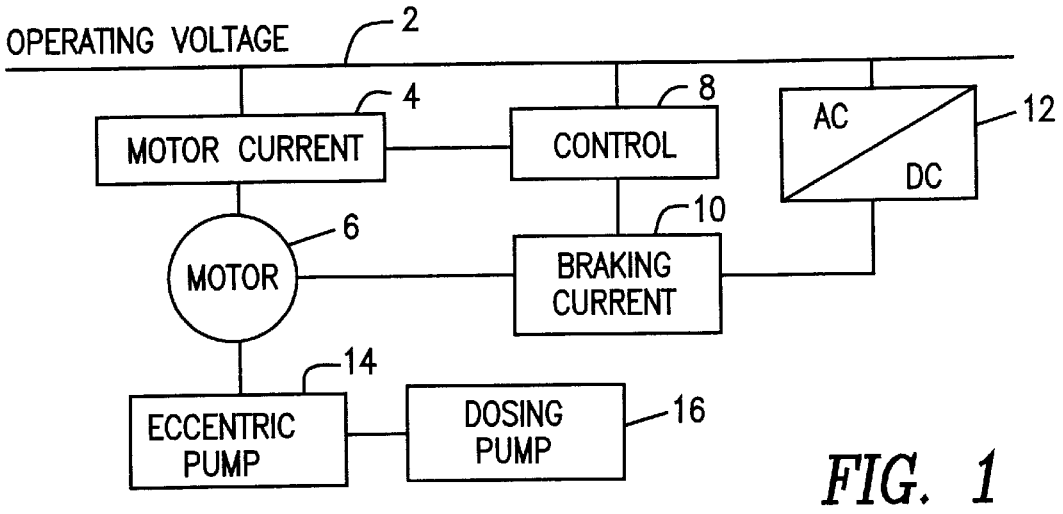
FIG. 1 is a block schematic diagram of one embodiment at the invention.
Figure 2:
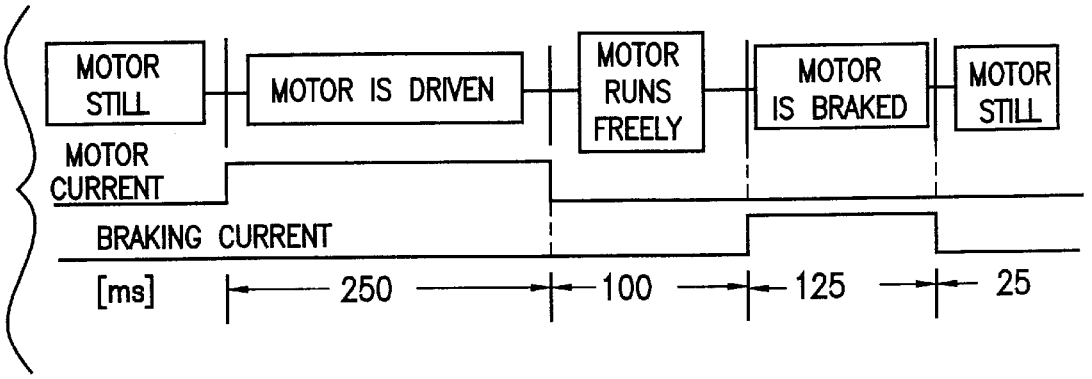
FIG. 2 is a composite flowchart and timing chart with motor and braking current waveforms, for an embodiment of the invention.

With reference to FIG. 1, in one embodiment of the invention, an AC operating voltage is applied via a voltage bus 2 to motor current driver 4 for providing power to an asynchronous motor 6. The motor 6 drives an eccentric gear 14 to operate a dosing pump 16. A control circuit 8 is provided for controlling the motor current driver 4, and a braking current driver 10. The AC voltage from bus 2 is applied to an AC/DC converter or rectifier 12, for providing a DC voltage to braking current driver 10. Please now refer to both FIG. 1 and FIG. 2. Operation of the invention relative to an embodiment for one method of the invention will now be described.

A time framework is drawn up by way of example in the following for a dosing pump with a cycle time of 500 ms which substantially corresponds to a stroke frequency of about 125 strokes/minute. In the stroke in which braking is to take place, the operating or supply voltage is still in place from the beginning of the cycle in the rear dead center for the duration of half a stroke of 250 ms. After passing through the front dead center, the supply voltage is switched off and, after about 100 ms, the motor is connected to a d.c. voltage for about 125 ms. After a time interval of about 25 ms, the cycle begins again. The application of a d.c. voltage generates an eddy current which dissipates the energy of the moment of inertia and stops the pump after completing the stroke in the rear dead center position until it is actuated again. Accordingly, the pump has completed exactly one stroke and can start up with no counter-moment in the next cycle. This sequence leads to a considerable increase in dosing precision and in the operational reliability of the pump.

In one embodiment of the invention, the braking current driver 10 is only activated when the actuation interval or time for the dosing pump 16 to complete a full stroke at least corresponds to the drive cycle time thereof. As indicated in the above example, for a drive cycle time of 500 ms, the dosing pump completes each stroke within 500 ms.

Although various embodiments of the invention have been shown and described, they are not meant to be limiting. Those of skill in the art may recognize certain modifications to theses embodiments, which modifications are meant to be covered by the spirit and scope of the appended claims.

What is claimed is:

1. A method for increasing the dosing precision of a dosing pump which is driven by an asynchronous motor via an eccentric gear, said method comprising the steps of:

switching on a supply voltage to said motor for driving said dosing pump for initiating an actuation interval;

switching off said supply voltage to said motor about half a cycle time before it is required to stop said motor to terminate the actuation interval for dosing by said dosing pump;

letting said motor run freely in an unpowered mode for about one quarter of the cycle time after said switching off step; and applying a DC voltage to said motor for about the next one quarter of the cycle time for inducing an eddy current in a rotor of said motor to generate a counter-magnetic field for breaking said rotor to a standstill.

2. A method as claimed in claim 1, characterized in that, wherein between the step of switching off of the supply voltage and application of a DC voltage, the motor runs freely until, after about 20% of the cycle time, the self-induction voltage has fallen to a value which does not affect the braking.

3. A method as claimed in claim 1 further including the step of switching off the supply voltage when the drive is in a dead center position after a compression stroke of the dosing pump.

4. A method as claimed in claim 1, wherein the motor is at a standstill for about 5% of the cycle time before reactuation in a dead center position after a suction stroke.

5. A method as claimed in claim 1, wherein the motor brake is only activated when the duration of the actuation intervals at least corresponds to the drive cycle time of the dosing pump.

6. A dosing pump driven by an asynchronous motor through an eccentric gear, wherein said dosing pump is operated by the method claimed in claim 1.

7. A method as claimed in claim 2, further including the step of switching off the supply voltage when the drive is in a dead center position after a compression stroke of the dosing pump.

8. A method as claimed in claim 2, wherein the motor is at a standstill for about 5% of the cycle time before reactuation in a dead center position after the suction stroke.

9. A method as claimed in claim 3, wherein the motor is at a standstill for about 5% of the cycle time before reactuation in the dead center position after the suction stroke.

10. A method as claimed in claim 2, wherein the motor brake is only activated when the duration of the actuation intervals at least corresponds to the drive cycle time of the dosing pump.

11. A method as claimed in claim 3, wherein the motor brake is only activated when the duration of the actuation intervals at least corresponds to the drive cycle time of the dosing pump.

12. A method as claimed in claim 4, wherein the motor brake is only activated when the duration of the actuation intervals at least corresponds to the drive cycle time of the dosing pump.

13. A dosing pump driven by an asynchronous motor through an eccentric gear, wherein said dosing pump is operated by the method claimed in claim 2.

14. A dosing pump driven by an asynchronous motor through an eccentric gear, wherein said dosing pump is operated by the method claimed in claim 3.

15. A dosing pump driven by an asynchronous motor through an eccentric gear, wherein said dosing pump is operated by the method claimed in claim 4.

16. A dosing pump driven by an asynchronous motor through an eccentric gear, wherein said dosing pump is operated by the method claimed in claim 5.

* * * * *